United States Patent [19]

Clements

[11] Patent Number: 4,867,314

[45] Date of Patent: Sep. 19, 1989

[54] AIR TIGHT SHELTERS

[75] Inventor: Harold J. Clements, Canterbury, United Kingdom

[73] Assignee: Airflex Containers Limited, Kent, United Kingdom

[21] Appl. No.: 784,714

[22] Filed: Oct. 4, 1985

Related U.S. Application Data

[63] Continuation of Ser. No. 614,788, May 29, 1984, abandoned.

[30] Foreign Application Priority Data

Aug. 18, 1983 [GB] United Kingdom ..... 8322248

[51] Int. Cl.[4] ..... B65D 81/20

[52] U.S. Cl. ..... 206/524.8; 206/335; 206/600; 403/107

[58] Field of Search ..... 150/52 R, 52 K, 55; 206/335, 522, 524.8, 600; 138/147, 151, 152; 248/408, 297.3; 403/107, 108, 326; 116/34 R, 34 A, 34 B

[56] References Cited

U.S. PATENT DOCUMENTS

| | | | |
|---|---|---|---|
| 905,778 | 12/1908 | Wolff | 116/34 R |
| 1,009,680 | 11/1911 | Mroczkowski | 248/408 |
| 1,101,267 | 6/1914 | Fretz | 248/408 |
| 1,481,654 | 1/1924 | Thomas | 116/34 B |
| 3,347,575 | 10/1967 | Morris | 403/107 |
| 3,656,494 | 4/1972 | Cornett et al. | 403/107 |
| 3,929,178 | 12/1975 | Hickey | 150/52 K |
| 4,140,191 | 2/1979 | Hickey | 206/524.8 |
| 4,181,230 | 1/1980 | Acuff | 403/108 |
| 4,261,401 | 4/1981 | Hickey | 206/524.8 |
| 4,284,287 | 8/1981 | Esposito | 403/108 |

*Primary Examiner*—David T. Fidei

*Attorney, Agent, or Firm*—Young & Thompson

[57] ABSTRACT

In an airtight shelter or container having an impermeable flexible base sheet sealed to an impermeable flexible cover sheet by an inflatable tubular seal within a slotted tubular frame, the slotted tubular frame is formed of lengths of slotted tube secured together by a flexible part annular locking element having a lug or projection resiliently engaging in aligned transverse apertures through mated slotted tubes.

5 Claims, 1 Drawing Sheet

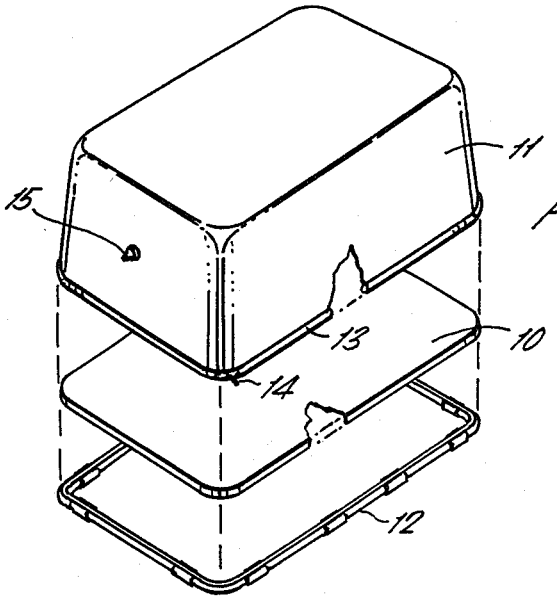
FIG. 1.
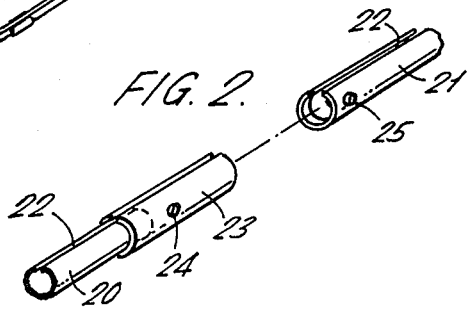
FIG. 2.
FIG. 3.
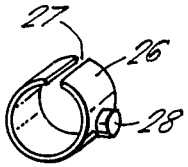
FIG. 4.
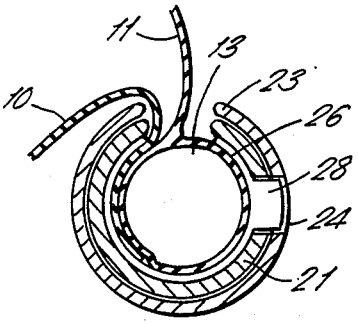

AIR TIGHT SHELTERS

This application is a continuation of application Ser. No. 614,788, filed 5/29/84 abandoned.

BACKGROUND OF THE INVENTION

1. Field of the Invention

This invention relates to an airtight container or shelter for goods which is formed cf impermeable sheet material and wherein the container or shelter can be at least partly collapsed by withdrawal of air into close fitting engagement with goods within the container.

2. Prior Art

For large articles such as vehicles, it is known from U.S. Pat. No. 3,929,178 to form a container with a flexible impermeable base sheet and a flexible impermeable cover sheet, the two sheets being sealed together around their peripheries by means of an inflatable sealing tube within a grooved or channel member. The peripheries of the two sheets may be inserted in a grooved or channel member, together with a separate inflatable tube or the inflatable tube may be secured to or integral with the periphery of one of the sheets and used to seal the periphery of the other sheet within the grooved or channel member.

It is most convenient to have the aforesaid grooved or channel member on or close to the ground around the vehicle or other article to be stored and hence this grooved or channel member is of substantial length in a container for vehicles. Most conveniently therefore it is formed in sections which are joined together.

SUMMARY OF THE INVENTION

It is an object of the present invention to provide an improved form of structure for such a container giving a simpler and more economical method of joining the frame members together and providing a structure which is less susceptible of damage or accidental disengagement than prior arrangements.

According to the present invention an airtight shelter or container having an impermeable flexible base sheet and an impermeable flexible cover sheet sealed together around the periphery of the container in a sealing frame has the sealing frame formed of a plurality of lengths of slotted tube with one end of one length fitting in an adjacent end of a next length with the slots aligned and with an inflatable tubular sealing element sealing the sheets together within the slotted tubular frame and wherein, to lock adjacent lengths of slotted tube together, there is provided within the inner tube a flexible part annular locking element having an outwardly extending lug or projection engaging in aligned transverse apertures through the mated slotted tubes.

With this arrangement, the locking element can conveniently be made of a plastics material. When in position and when the sealing tube is inflated, the locking element is held firmly by the inflated tube with the lug or projection extending through the apertures in the slotted tubes. It thus prevents withdrawal of one tube from the other in the axial direction. However, when the pressure is released from the inflatable tube, the structure is readily dismantled simply by pressing in the lug or projection to deform the locking element slightly, permitting withdrawal of one tube from the other. It will be noted that the locking does not depend on the resilience of the locking element or on the provision of clamps or the like but is inherently effected by the inflation of the inflatable tube. The locking elements however are very conveniently made of resilient plastics material so that they snap into position when the frame structure is assembled.

It will be particularly noted however that the locking members can be made from non-metallic material to reduce risk of corrosion. The lug or projection on each locking element constitutes a registering dowel for alignment and locking of the engaged tubes on assembly and is thus semi-automatic in function.

Conveniently the lengths of slotted tubing are formed with, at one end only, a short length of larger diameter slotted tubing to receive the end of the next length of slotted tubing. Thus only one locking element would be required for each joint between adjacent lengths of the frame. Obviously however, if so desired, lengths of slotted tubing of uniform diameter could be employed with a short sleeve extending over abutting or closely adjacent ends of two lengths and locked in the manner described above.

BRIEF DESCRIPTION OF THE DRAWINGS

FIG. 1 is an exploded view of a shelter or container showing the principal components of one embodiment of the invention;

FIG. 2 shows to a larger scale adjacent ends of two lengths of slotted tubular framing for the container of FIG. 1;

FIG. 3 shows a locking element for use in joining the two lengths of framing; and FIG. 4 is a sectional view through the slotted tubular frame where joined.

DESCRIPTION OF THE PREFERRED EMBODIMENTS

Referring to FIG. 1 there is shown a container having a flexible impermeable base sheet 10 and a flexible impermeable cover sheet 11. Both sheets might typically be made of butyl rubber. The two sheets are sealed together by inserting their peripheries into a slotted tubular sealing frame 12 which extends around the periphery of the container at the base thereof. The sheets are sealed together in the tube by inflating a sealing tube 13 which, in this embodiment, is formed integrally with the cover sheet 11 around the periphery thereof. This tube is inflated by means of a one-way valve 14 and holds the periphery of the base sheet 10 tightly against the wall of the tube 11 thereby sealing the two sheets together. The container can then be evacuated or partially evacuated via a one-way valve 15 to collapse the upper sheet down to close-fitting engagement with goods in the container.

The present invention is concerned more particularly with the manner of forming the tubular frame 12 and this is illustrated in more detail in FIGS. 2, 3 and 4. The frame is made up of a number of lengths of slotted tube such as the lengths 20, 21 shown in FIG. 2, each length having a longitudinal slot 22 for insertion of the aforementioned sheets. On one end of each length there is secured, e.g. by welding, a short connecting tube 23, also slotted and with its slot aligned with the slot 22 in the length to which it is attached. This tube 23 has at least one radially extending aperture 24. A corresponding aperture 25 is formed in the adjacent end of the length 21, the apertures being positioned so that they are aligned when the end of length 21 is inserted into the tube 23 to abut against the end of length 20 and with the longitudinal slots 22 aligned. The tubes are locked together by means of a flexible part-annular locking element 26 shown in FIG. 3 which locking element has a longitudinal slot 27 for alignment with the slots 22 and also has a projecting portion 28 which is conveniently formed integrally with the locking element 26 but may be attached thereto. As shown in FIG. 4, when the components of the joint are assembled, the projecting element 28 extends through the aligned apertures 24, 25 so locking the two lengths of tube 20, 21 together. The periphery of the base sheet 10 and the inflatable tube 13 around the periphery of the cover sheet 11 are inserted through the longitudinal slot 22 and the tube 13 is inflated so as to press the periphery of the cover sheet tightly against the inner surface of the locking ring 26 and of the slotted tubes. The locking element 26 is conveniently formed of a flexible plastics material and the inflation of tube 13 presses the projecting portion 28 into the apertures 24, 25 so ensuring that the tubular frame remains firmly locked. It is convenient to form the locking element 26 of resilient plastics material so that the projecting portion 28 can be snapped into position and will remain correctly located with the projection 28 in the apertures whilst the tube and base sheet are being inserted into the assembled framework.

With this construction, the slotted tubular frame 12 can readily be formed in sections which are assembled together. It will be borne in mind that containers of the kind described might typically be used as shelters for large equipment such as vehicles and the formation of the framework in sections is desirable for transport purposes. After the framework has been assembled, the base sheet 10 is put in position, the goods, such as the vehicle to be stored, are put on the base sheet 10 and the cover is put over and then sealed in position in the manner previously described. The container can then be partially evacuated via the valve 15 so minimising the amount of air and hence moisture within the container. It is readily possible to dismantle the container and the frame sections can be unlocked merely by depressing the projecting portion 28 to release the locking element 26 from engagement with the slotted tubes.

Instead of having the external connecting tube 23 welded or otherwise secured to one end of a length, such as length 20, of slotted tube, this external connecting tube might alternatively be provided as a mechanically separate member for jointing at each end to a length of slotted tube by the method described above. This would eliminate any necessity for welding or otherwise securing the connecting tube 23 to a length of slotted tube.

The curved tubular members at the corners of tubular frame 12 are conveniently formed as castings, if they are of metal, or as moulded components if they are of rigid non-metallic material, e.g. a plastics material; the use of castings or mouldings avoids the necessity for further fabrication or machining in production of the components. Such cast or moulded components can embody the continuous slot 22 and can be formed integrally with an end collar or collars 23 to facilitate jointing to associated straight tube members.

The construction described, with projecting portions 28 extending into apertures 24, 25, has a particular advantage in that a user, checking the pneumatic security of the seal, can make a convenient and useful judgement of the prevailing pressure condition in tube 13 by depressing the portion 28.

I claim:

1. An airtight shelter or container having an impermeable flexible base sheet and an impermeable flexible cover sheet sealed together around the periphery of the container in a sealing frame wherein the sealing frame is formed of a plurality of lengths of slotted tube with one end of one length fitted in an adjacent end of the next length wit the slots aligned and with an inflatable tubing sealing element sealing the sheets together within the slotted tubular frame and wherein to lock adjacent lengths of slotted tube together, there is provided within the inner tube a part annular flexible ring having an axis coincident with the axis of the inner tube, the ring having an axially extending slot which is aligned with the slots in the tubular frame, the inner and outer tubes having apertures in the walls thereof which are aligned one with another when the slots in the tubes are in alignment whereby the inner and outer tubes can be assembled by sliding one within the other with said slots aligned until said apertures come into alignment with each other, the annular flexible ring having a radially outwardly extended projection on the outer periphery thereof which engages in the aligned transverse apertures in the slotted tubes to hold the tubes together against separation, the annular flexible ring encircling the inflatable tubing sealing element whereby said inflatable sealing element when inflated presses said projection into said apertures thereby to ensure that said frame remains securely locked, and said projection in said aligned apertures being disposed outside the shelter or container whereby a user of the container can judge the prevailing pressure condition in said inflatable sealing element by depressing said projection.

2. A shelter or container as claimed in claim 1 wherein the ring is made of a plastics material.

3. A shelter or container as claimed in claim 1 wherein the ring is made of resilient material.

4. A shelter or container as claimed in claim 1 wherein the lengths of slotted tube are formed with, at one end only, a short length of larger diameter slotted tube to receive the end of the next length of slotted tube whereby only one ring is required for each joint between adjacent lengths of the frame.

5. A shelter or container as claimed in claim 1 wherein each length of slotted tube is joined, at each end, to an adjacent length by connecting tubing of larger diameter, and wherein a said ring is arranged to engage and lock each length of slotted tube at each end to the connecting tube.

* * * * *